United States Patent [19]

Yarmark

[11] Patent Number: 4,850,900

[45] Date of Patent: Jul. 25, 1989

[54] LIGHT FIXTURE LAMPHOLDER

[75] Inventor: Martin J. Yarmark, Huntingdon Valley, Pa.

[73] Assignee: Triboro Electric Corp., Doylestown, Pa.

[21] Appl. No.: 124,398

[22] Filed: Nov. 20, 1987

Related U.S. Application Data

[63] Continuation of Ser. No. 818,427, Jan. 13, 1986, abandoned.

[51] Int. Cl.[4] ..... H01R 25/00

[52] U.S. Cl. ..... 439/648; 439/665; 439/701

[58] Field of Search ..... 439/701, 168, 182, 220, 439/280, 336, 356, 360, 375, 414, 419, 541, 558, 602, 605, 661–667, 731, 752, 696, 641, 642, 643, 648

[56] References Cited

U.S. PATENT DOCUMENTS

| | | | |
|---|---|---|---|
| 1,418,302 | 6/1922 | Guth | 339/119 L |
| 1,478,119 | 12/1923 | Herskovitz | 339/162 |
| 2,686,841 | 6/1954 | Boutelle | 339/162 |
| 2,889,451 | 6/1959 | Longo | 339/119 L |
| 3,196,379 | 7/1965 | Sams et al. | 339/157 C |
| 4,612,094 | 3/1977 | Van Renssen et al. | 339/206 L |

FOREIGN PATENT DOCUMENTS

| | | | |
|---|---|---|---|
| 1367787 | 9/1974 | United Kingdom | 339/125 L |

*Primary Examiner*—David Pirlot
*Attorney, Agent, or Firm*—Blum Kaplan

[57] ABSTRACT

A light fixture lampholder having at least one bulb socket for receiving a light bulb and a mounting structure for mounting the lampholder to a light fixture. The lampholder includes first and second complementary lampholder sections each integrally molded from a plastic material. The first and second lampholder sections each define integrally molded portions of the bulb socket and the mounting means. Electrical contacts are supported by the first and second lampholder sections for supplying an electrical current to the bulb socket. A coupling device couples the first lampholder section to the second lampholder section, with the respective integrally molded portions of the first and second lampholder sections mating to form the bulb socket and the mounting structure when the first and second lampholder sections are coupled by the coupling device.

32 Claims, 4 Drawing Sheets

FIG. 1
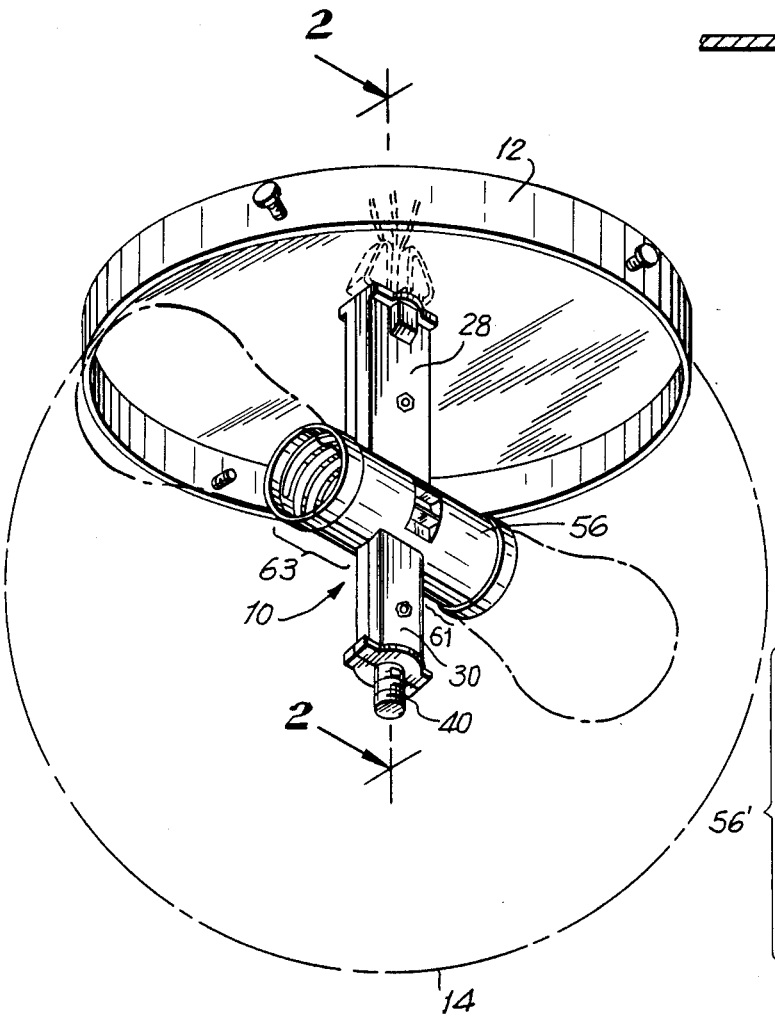
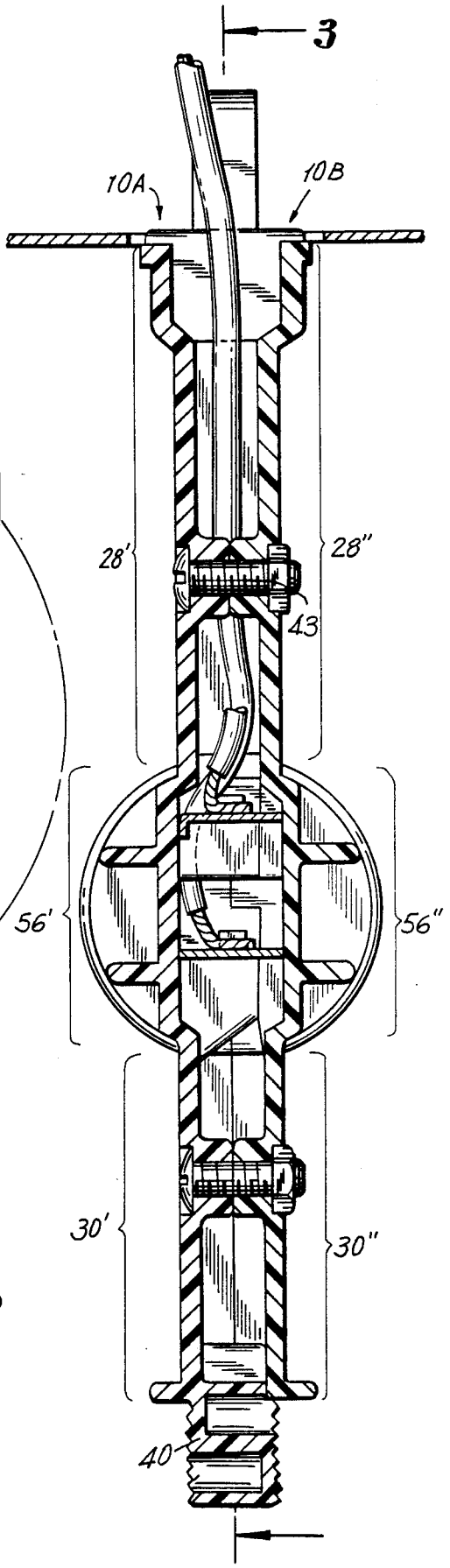
FIG. 2

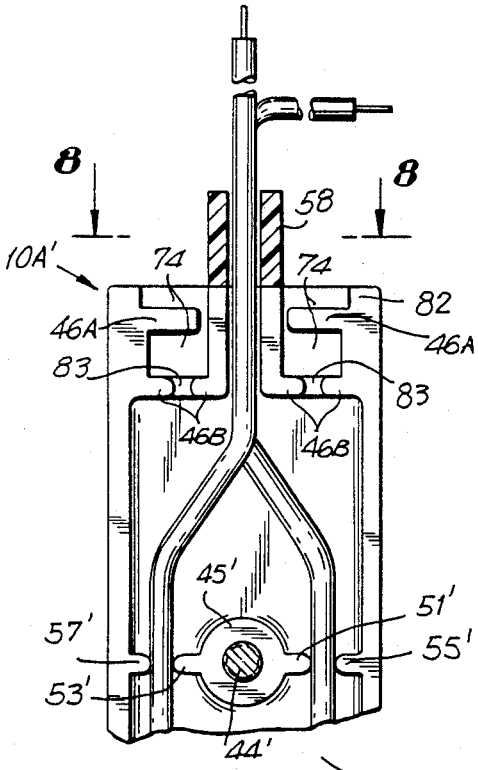
FIG. 7
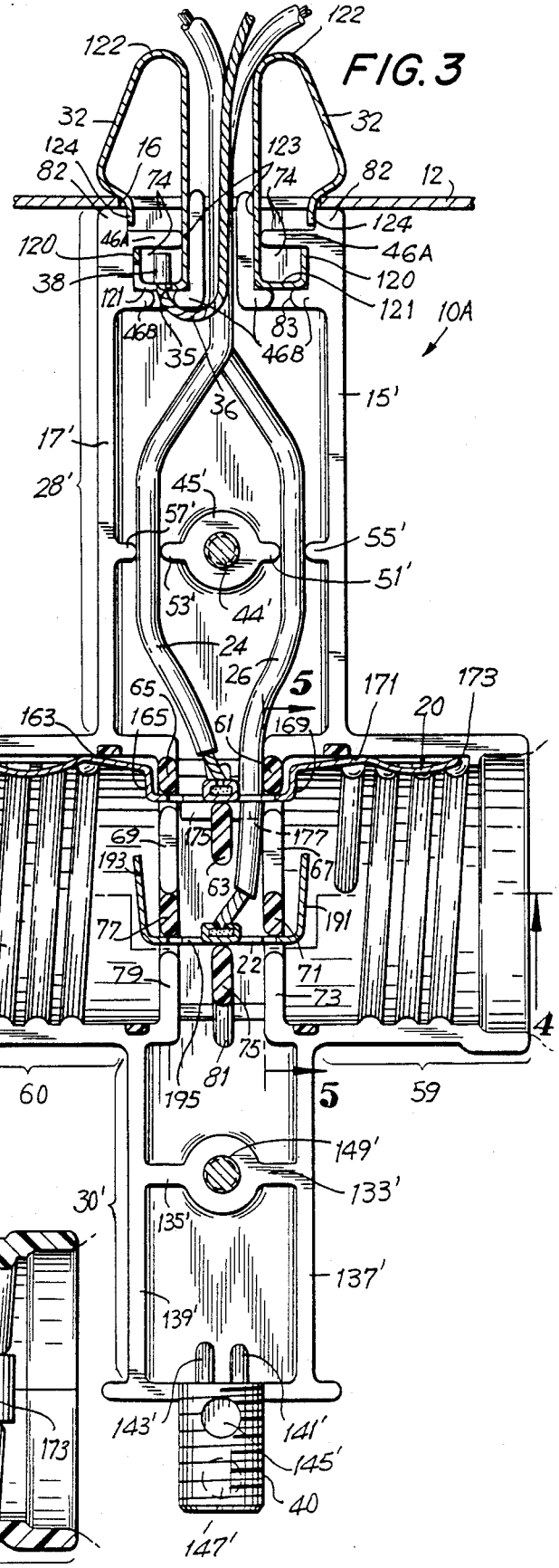
FIG. 3
FIG. 4

FIG. 5
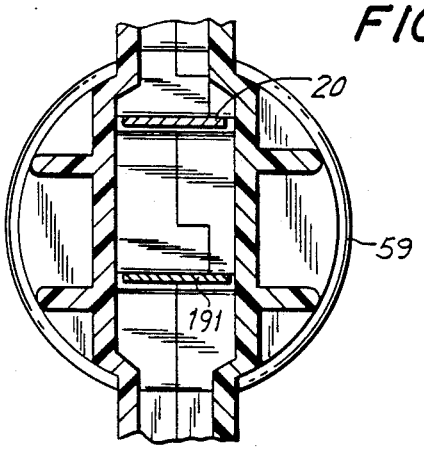
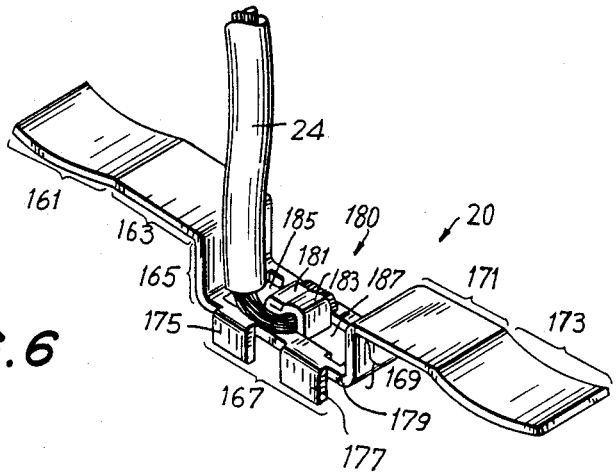
FIG. 6
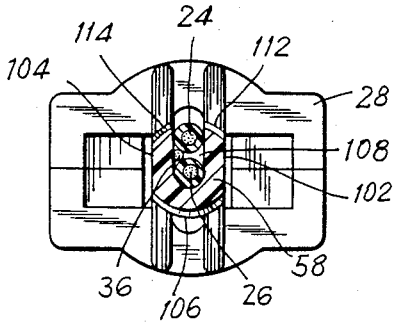
FIG. 8

FIG. 9
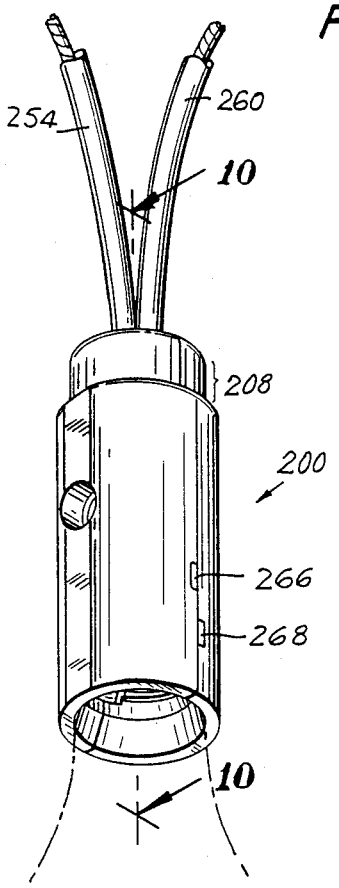
FIG. 10
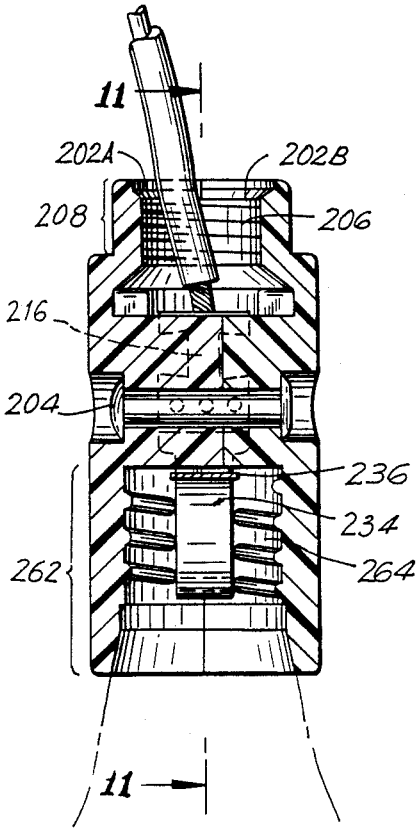
FIG. 11
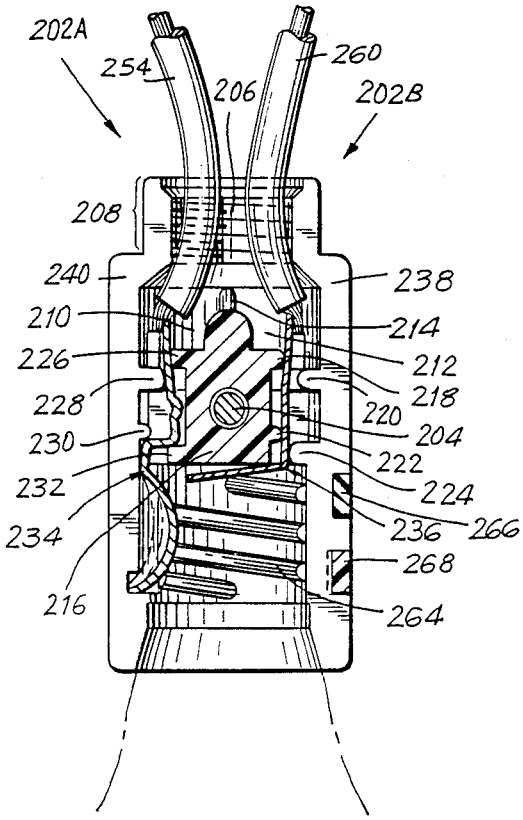
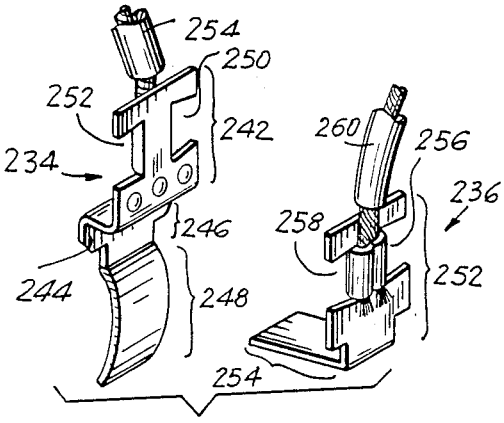
FIG. 12

LIGHT FIXTURE LAMPHOLDER

This is a continuation of application Ser. No. 06/818,427, filed Jan. 13, 1986 now abandoned.

BACKGROUND OF THE INVENTION

This invention relates to light fixture lampholders and, in particular, to novel molded light fixture lampholders.

Light fixture lampholders and, in particular, twin-light fixture lampholders, are well-known in the prior art. Such lampholders are made, for example, using molded socket housings. Metal brackets, especially upper and lower steel brackets, are secured to the housings and are used primarily to position the lampholders in a ceiling, lamp or wall attachment. These prior art lampholders generally require screw shells inside the molded socket housings to hold and to supply electrical contact to light bulbs secured in the socket housings although configurations having molded lamp threads and not requiring the use of screw shells are also known. Generally, a ground wire is riveted to an upper steel bracket with a terminal lug. A threaded nipple for securing an ornamental lamp fixture to the lampholder is optionally secured to a lower bracket. Because such lampholders have so many separate parts, assembly is time consuming and relatively expensive.

Candelabra lampholders having a single integral socket housing, are also well known. Such candelabra lampholders consist of a molded socket housing having molded socket threads and strip contacts inside the housing for supplying electrical contact to a light bulb secured in the housing. A metal mounting bracket, mounting means or mounting end is secured to the housing and is used primarily to position the candelabra lampholder. Again, the use of separate parts for the housing and the bracket is time consuming and relatively expensive.

Accordingly, it is desirable to provide molded light fixture lampholders which overcome the disadvantages inherent in prior art lampholders.

SUMMARY OF THE INVENTION

Generally speaking, in accordance with the invention a molded light fixture lampholder is provided. In one preferred embodiment, the lampholder is a twin-light fixture lampholder. Molded socket housings having molded socket threads, molded upper and lower brackets and an optional molded threaded nipple are integral features of the molded lampholder. Each socket may be provided with molded socket threads having a longitudinally extending flattened region for receiving a strip contact, in place of the conventional screw shells. Mounting springs can be mounted on the end of the upper bracket and a ground wire can be secured to at least one of the mounting springs. The lampholder is molded in two cooperating sections that are held together by rivets, eyelets or screws in order to form the light fixture lampholder.

In an alternate preferred embodiment, the lampholder has a single integral socket and a mounting bracket or mounting means. A molded socket housing having molded socket threads is provided. A strip contact is positioned inside the molded socket housing for the purpose of providing electrical contact between a light bulb secured in the socket housing and an external power source. The lampholder is molded in two cooperating sections that are held together by rivets, eyelets or screws in order to form the lampholder.

It is, therefore, an object of the invention to provide a novel molded light fixture lampholder.

It is a further object of the invention to provide a novel molded light fixture lampholder that includes integrally molded sockets, brackets and, optionally, a threaded nipple as integral features and that is molded in two cooperating sections.

It is another object of the invention to provide a light fixture lampholder wherein electrical current is provided to one or more light bulbs secured therein by strip contacts.

It is yet another object of the invention to provide a novel molded twin-light fixture lampholder.

It is a still further object of the invention to provide a novel molded lampholder having a single integral socket housing and a mounting bracket or mounting means.

Still other objects and advantages of the invention will in part be obvious and will in part be apparent from the specification and the drawings.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is made to the following description taken in connection with the accompanying drawings, in which:

FIG. 1 is a perspective view of an ornamental lamp fixture incorporating a twin-light fixture lampholder of the present invention;

FIG. 2 is a cross-sectional view of a twin-light fixture lampholder of the present invention taken through section line 2—2 of FIG. 1;

FIG. 3 is a cross-sectional view of a twin-light fixture lampholder of the present invention taken through section line 3—3 of FIG. 2;

FIG. 4 is a cross-sectional view of a twin-light fixture lampholder of the present invention taken along line 4—4 of FIG. 3;

FIG. 5 is a cross-sectional view of a socket portion of a twin-light fixture lampholder of the present invention taken along line 5—5 of FIG. 3;

FIG. 6 is a perspective view of a strip contact for use in a twin-light fixture lampholder of the present invention;

FIG. 7 is a partial front plan view of an alternate embodiment of a section of the upper bracket of the present invention with a portion sectioned;

FIG. 8 is a cross-sectional view of an upper bracket of the alternate embodiment of FIG. 7 taken through line 8—8 of FIG. 7;

FIG. 9 is a perspective view of a lampholder having a single integral socket housing and a mounting bracket or mounting means in accordance with the present invention;

FIG. 10 is a cross-sectional view of a lampholder having a single integral socket housing and a mounting bracket or mounting means of the present invention taken through line 10—10 of FIG. 9;

FIG. 11 is a cross-sectional view of a lampholder having a single integral socket housing and a mounting bracket or mounting means of the present invention taken through line 11—11 of FIG. 10; and FIG. 12 are perspective views of strip contacts for use in lampholders having a single integral socket housing and a mounting bracket or mounting means of the present invention.

DETAILED DESCRIPTION OF THE INVENTION

Referring to FIGS. 1–8, a first preferred embodiment of the invention is shown. The invention is shown in the form of a molded twin-light fixture lampholder 10 that is molded in two cooperating sections 10A and 10B. Secton 10A has an upper bracket portion 28', a socket portion 56', and a lower bracket portion 30'. Similarly, section 10B has an upper bracket portion 28'', a socket portion 56'', and a lower bracket portion 30''. Upper bracket portions 28' and 28'' cooperate to form upper bracket 28, socket portions 56' and 56'' cooperate to form socket housings 56, and lower bracket portions 30' and 30'' cooperate to form lower bracket 30. Lampholder 10 is optionally provided with lower molded threaded nipple 40. Securing means for securing cooperating section 10A to cooperating section 10B and mounting means for mounting lampholder 10 to a ceiling, lamp or wall attachment, such as mounting plate 12, are also provided. In FIG. 1, a globe 14 is shown in chain lines mounted to mounting plate 12. Lampholder 10 will be described in detail starting from the top of the lampholder as shown in the drawings and continuing towards the bottom of the lampholder.

Mounting means for mounting lampholder 10 to a ceiling, lamp or wall attachment adjoin and are coupled to an upper edge of upper bracket 28. In a preferred embodiment of the invention, the mounting means include mounting springs or brackets 32 positioned adjacent an upper edge of upper bracket 28. Mounting springs or brackets 32 fit into a corresponding opening 16 (FIG. 3) in mounting plate 12. The shape of the mounting springs or brackets 32 is, in part, defined by mounting bracket securing flanges described below, which hold the mounting springs or brackets 32 in position in upper bracket 28 of lampholder 10.

As can be seen most clearly in FIG. 3, the mounting bracket securing flanges are preferably comprised of flange parts 46A and 46B that define a substantially C-shaped cavity 74. Flange part 46A of each upper bracket portion 28', 28'' is substantially linear and extends horizontally from a sidewall of upper bracket portions 28', 28'' towards the center of each upper bracket portion 28', 28''. Flange part 46B is angular, preferably right angular. In a preferred embodiment, flange part 46B extends downwardly from an upper edge of each upper bracket portion 28', 28'', in the direction of the lower edges of upper bracket portions 28', 28'', and then horizontally to the respective side wall of upper bracket portions 28', 28'' from which the corresponding flange part 46A extends. The vertically extending section of flange part 46B is perpendicular to flange part 46A and the horizontally extending section of flange part 46B is parallel to and below flange part 46A. Substantially C-shaped cavity 74 is defined by the interior edge of upper bracket portion side wall 82, the periphery edge of flange part 46A and the interior edge of flange part 46B, upper edge of upper bracket 28. In addition to the structure described, end flange part 46B has an aperture 83 therethrough its horizontal section, the purpose of which will be described below.

Each mounting spring or bracket 32 has a substantially J-shaped extension consisting of upwardly-bent end 120, horizontal section 121, and a second upwardly extending section 123 that is adapted to secure the mounting spring or bracket 32 in the mounting bracket securing flanges. Each mounting spring or bracket 32 also includes a bent exterior section 122 and an interior extending projection 124. The free end of upwardly-bent end 120 of the J-shaped extension abuts against a lower edge of mounting bracket securing flange part 46A at a point adjacent the interior edge of upper bracket portions side wall 82. The upwardly-bent end 120 extends along interior edge of upper bracket portion side wall 82 and is retained by the bottom edge of flange part 46A. Horizontal section 121 abuts against the horizontal interior edge of flange part 46B and the second upwardly extending section 123 abuts against the vertical interior edge of flange part 46B. Bent exterior section 122' extends outwardly from upper bracket portions 28' and 28'' and is bent in such a way that interior extending projection 124 returns to the interior of upper bracket portions 28' and 28'' along interior edge of upper bracket portion side wall 82. The free end of interior extending projection 124 abuts against the upper edge of flange part 46A at a point substantially opposite the point at which the free end of upwardly-bent end 120 abuts the lower edge of flange part 46A.

As can be seen, the arrangement of the mounting springs or brackets 32 permits bent exterior section 122 to be pressed together in order to fit through an opening 16 in ceiling, lamp or wall attachment 12. The bent exterior section 122 can be any configuration that will permit the mounting springs or brackets 122 to return to their original configuration when the pressing action is discontinued. In a preferred embodiment, two sets of mounting bracket securing flanges are provided in order to secure two mounting springs or brackets 32, one on either side of upper bracket 28. Mounting springs or brackets 32 are formed of elastically deformable metal strips or other suitable material.

At least one of the mounting springs or brackets 32 has a slot 35 (FIG. 3) adapted to retain ground wire 36. The slot is positioned adjacent the aperture 83 in the horizontal edge of flange part 46B. The ground wire is placed so that one end extends through slot 34 into the interior of C-shaped cavity 74. A ferrule 38 or similar device is attached to the end of ground wire 36 that extends into cavity 74. The ferrule 38 secures the ground wire 36 to the mounting spring or bracket 32. The ground wire 36, which extends downwardly into the interior of upper bracket 28, is bent so as to extend upwardly between the exterior edge of flange parts 46B and to exit upper bracket 28. Mounting springs or brackets 32 are positioned in upper bracket portion 10A of lampholder 10 after molding is completed, but prior to securing cooperating section 10A to cooperating section 10B.

In an alternate embodiment (not shown), one of the mounting springs or brackets 32 may be provided with notches in the sides thereof in the region where aperture 83 is provided in the depicted embodiment. A ground wire 36 may be wrapped around the mounting spring or bracket 32 so as to be fitted between the notches. In this embodiment, firm contact is made between the mounting spring or bracket 32 and the ground wire 36 when cooperating sections 10A and 10B are assembled and secured together. Pressure is applied to the mounting spring or bracket 32 by the horizontal sections of flange part 46B. Contact is maintained even if cooperating sections 10A and 10B loosen slightly.

In a further alternate embodiment, shown in FIGS. 7 and 8, a molded upper threaded nipple is provided instead of the mounting springs or brackets 32 as the means for mounting lampholder 10 in a ceiling, lamp or wall attachment 12. A lower edge of the molded upper threaded nipple 58 adjoin an upper edge of upper bracket 28. Molded upper threaded nipple 58 is secured to only one of upper brackets portions 28′ or 28″; the other of upper bracket portions 28′ and 28″ is adapted to receive molded upper threaded nipple 58.

Upper threaded nipple 58 has a substantially U-shaped configuration in order to facilitate the assembly of wires through nipple 58, as can be seen most clearly in FIG. 8. Flattened side areas 102 and 104 permit upper threaded nipple 58 to be removed from a mold without damaging nipple threads 110 in threaded areas 106, 112 and 114. Recessed portion 108 is provided in order to permit first and second wire leads 26 and 24 and ground wire 36 to exit lampholder 10 for connection to an external power source. Additionally, upper bracket 28 has an extension (not shown) that fits into the U-shaped slot and protects the wires from contacting fixture holder 12 and from getting nicked. Other equivalent mounting means for mounting lampholder 10 in a ceiling, lamp or wall attachment 12 are also within the scope of the invention.

At approximately the midpoint between the mounting means and socket housings 56, upper bracket portions 28′ and 28″ are provided with hubs 45′ and 45″ surrounding holes 44′ and 44″. Referring to FIG. 3, hubs 45′ on upper bracket portions 28′ define eyelet holes 44′ through which rivets, eyelets or screws 43 can be secured so as to fasten cooperating section 10A to cooperating section 10B. Hubs 45′ are raised portions that also serve to provide support for upper bracket portion 28′ and eyelet holes 44′.

Hub 45′ has horizontal projections 51′ and 53′ that extend towards opposite side walls of upper bracket portion 28′. Horizontal projections 51′ and 53′ extend from opposite sides of hub 45′ about one-third of the distance to the nearest upper bracket portion sidewall. Inward horizontal projections 55′ and 57′ extend from sidewalls 15′ and 17′ about one-third (⅓) of the distance to hub 45′. If horizontal projections 57′, 53′, 51′ and 55′ were connected along their respective lengths, a straight horizontal line would be formed. The gaps (not shown) between horizontal projections 57′ and 53′ and between 55′ and 51′ serve as guide means for positioning first and second wire leads 24 and 26 in lampholdeer 10.

A lower edge of upper bracket 28 abuts an upper edge of socket housings 56. Referring to FIGS. 3 and 5, a center portion of socket portions 56′, 56″ between first and second sockets 59 and 60 is defined by a series of raised parallel ribs extending vertically in the center portion of socket housings 56. The ribs are provided in order to lend structural integrity to and to permit easier molding and assembly of lampholder 10. It will be understood that the precise arrangement of ribs is not limited to the arrangement shown.

In a preferred embodiment, the tops of ribs 61, 63, 65, 71, 75 and 77 extend above the plane of sidewalls 15′ and 17′. The tops of ribs 67, 69, 73, 79 and 81 lie in the plane of sidewalls 15′ and 17′. Corresponding ribs in the center portion of socket housing 56″ mate with or fit into the gaps between the ribs in socket housing 56′.

Ribs 61, 67, 71 and 73 extend in a straight line from the top of socket portion 56′ to the bottom of socket portion 56′ along an interior edge of first socket 59. Gaps between ribs 61 and 67 and also between ribs 71 and 73 permit positioning of first and second strip contacts 20 and 22, respectively. Similarly, ribs 65, 69, 77 and 79 extend in a straight line from the top of socket portion 56′ to the bottom of socket portion 56′ along an interior edge of second socket 60. Gaps between ribs 65 and 69 and also between ribs 77 and 79 permit positioning of first and second strip contacts 20 and 22, respectively. Ribs 63, 75 and 81 extend parallel to and between the ribs adjacent the interior edge of first socket 59 and the ribs adjacent the interior edge of second socket 60. In an especially preferred embodiment, ribs 61, 63 and 65 cooperate to position first strip contact 20 and ribs 71, 75 and 77 cooperate to position second strip contact 22.

Molded socket threads 84 inside first and second sockets 59 and 60 are provided for the purpose of securing light bulbs 54 inside sockets 59 and 60 when lampholder 10 is assembled. A flattened portion 84′ comprised of a discontinuity in the socket threads 84 is provided along an upper edge of sockets 59 and 60 in order to permit first strip contact 20 to abut against the threaded conductive region of light bulbs 54 when light bulbs 54 are secured in sockets 59 and 60.

First strip contact 20 is shown in FIG. 6. Strip contact 20 is preferably formed from a strip of conductive metal such as copper or the like. In a preferred embodiment, strip contact 20 includes a first convex contact portion 161, a first flat positioning section 163 adjacent first convex contact portion 161, a first vertical portion 165 adjacent the first flat position securing section 163, a center wire securing portion 167 adjacent the first vertical portion 165, a second vertical portion 169 adjacent center wire securing portion 167, a second flat position securing section 171 adjacent second vertical portion 169, and second convex contact portion 173 adjacent second flat position securing section 171.

Center wire securing portion 167 has two tabs 175 and 177 extending downwardly along a side edge 179 of center wire securing portion 167. Tabs 175 and 177 are used to position strip contact 20 in position in socket housings 56 (FIG. 3). Center wire securing portion 167 also includes wire securing means 180 for securing a contact wire 24 to strip contact 20. In a preferred embodiment, wire securing means 180 are in the form of bent flanges 181 and 183 which are cut out from a center portion of strip contact 20 and bent around an uninsulated portion of wire 24 so as to hold wire 24 in position. When the wire securing flanges 181 and 183 are cut and bent, strip contact 20 is left with holes 185 and 187 in center wire securing portion 167.

In use (FIG. 3), strip contact 20 is positioned in socket portions 56′ so that tabs 175 and 177 sit on opposite sides of rib 63 and the center portion of strip contact 20 fits between ribs 61 and 67 and between ribs 65 and 69, respectively, in such a way that first vertical portion 165 extends adjacent and substantially parallel to rib 65 and second vertical portion 169 extends adjacent and substantially parallel to rib 61. First wire lead 24 coupled to first strip contact 20 extends upwardly through the interior of upper bracket portion 28′ between horizontal projections 53′ and 57′ and exits upper bracket portion 28′ between the vertical portion of mounting bracket securing flange 46B. Flat positioning sections 163 and 171 and convex portions 161 and 173 fit into the longitudinally extending flattened region of molded socket thread 83 and contact a light bulb when the light bulb is secured in sockets 59 and 60.

Second strip contact 22 is of a type that is well known in the art. Strip contact 22 is made of a single strip of metal such as copper and the like. Legs 191 and 193 are positioned adjacent a center wire holding section 195. A second wire lead 26 is appropriately secured to second strip contact 22. When strip contact 22 is positioned inside the center portion of socket housings 56', it extends in the gaps between ribs 77 and 79 and between ribs 71 and 73 and is abutted by an upper edge of rib 75. Second wire lead 26 connected to second strip contact 22 extends upwardly through the interior of upper bracket portion 28' between horizontal projections 51' and 55' and exits upper bracket portion 28' between the vertical portion of mounting bracket securing flanges 46B. When a light bulb 54 is secured in socket housings 59 and 60, the center tip portion of the light bulb 54 makes contact with either of legs 191 or 193.

An upper edge of lower bracket portion 30' lies adjacent a lower edge of socket housings 56'. Hub 131' is positioned approximately midway between the upper and lower edges of lower bracket portion 30'. Hub 131' is substantially the same as hub 45' in upper bracket portion 28'. Horizontal projections 133' and 135' extend the and 139' , respectively. No gaps are provided in the horizontal portions.

Upwardly extending flanges 141' and 143' extend from a lower edge of lower bracket portion 30' into the interior of upper bracket portion 30'. The flanges 141' and 143' are provided opposite lower threaded nipple 40 for the purpose of lending support to lower bracket portion 30'.

Lower threaded nipple 40 lies adjacent a lower edge of lower bracket portion 30' along an upper edge of upper threaded nipple 40. As with upper threaded nipple 58, flattened portions are provided for ease of molding. Additionally, openings 145' and 147' extend through the interior of threaded nipple 40 from opposite sides of the threaded portions of nipple 40. These openings are also provided for ease of molding.

As shown in the drawings, threaded nipple 40 on section 10A fits into a corresponding opening on section 10B adapted to receive threaded nipple 40. In another embodiment (not shown), half of threaded nipple 40 is integral to section 10A and the other half is integral to section 10B. Each half would include a half cylinder of threads with flattened regions and without holes. When the cooperating sections 10A and 20B are arranged so as to form lampholder 10, the two halves of the threaded nipple cooperate to form threaded nipple 40.

In use, cooperating section 10A is secured to cooperating section 10B by rivets, eyelets or screws 43 which extend through holes 44' and 149' in upper and lower bracket portions 28', 28'', 30' and 30'', respectively. First and second wire leads 24 and 26 extend upwardly through upper bracket 28 and exit lampholder 10 for connection to an external power source. In a preferred embodiment, the external power source includes means for turning the bulbs 54 on and off. The lampholder 10 of the present invention is a "dumb" holder and does not include such means.

A globe 14 can be attached to a ceiling, a lamp or a wall attachment 12 for aesthetic purposes. In an alternate embodiment (not shown), a shade or globe is secured directly to the lampholder 10. This is accomplished by positioning molded threaded nipple 40 on molded lower bracket 30 through a corresponding hole in the shade or globe. The fixture ornament is then secured to lampholder 10 by means of a conventional nut or equivalent securing device (not shown) positioned so that the shade or globe is between the molded lower bracket 30 and the nut.

Referring to FIGS. 9–12, an alternative embodiment of the invention in the form of a candelabra lampholder 200 is shown. Candelabra lampholder 200 is molded in two cooperating section 202A and 202B in a manner similar to that described in connection with twin-light fixture lampholder 10. Cooperating sections 202A and 202B are held together by a single rivet, eyelet or screw 204 extending through openings in cooperating sections 202A and 202B. In general, candelabra lampholder 200 is smaller than twin-light fixture lampholder 10 and holds a small light bulb for use in a chandelier or other decorative lighting ornament. However, a similar, but larger, design can be used for a single medium base lamp socket.

Referring to FIGS. 10 and 11, an upper section 208 has incorporated screw threads 206 on an interior surface. This permits candelabra lampholder 200 to function as a female member for securement to a suitable lamp fixture.

As shown most clearly in FIG. 11, cavity portions 210 and 212 adjoin upper portion 208 in such a way that upper edges of cavity portions 210 and 212 are adjacent a lower edge of upper portion 208. Cavity portions 210 and 212 are separated by vertical rib 214. Vertical rib 214 is provided to lend support to the upper portion of candelabra lampholder 200, and to provide a stop for a male threaded part.

A center box portion 216 having a semi-circular projection along an upper edge is provided around the inside of a hole adapted to receive a rivet, eyelet or screw 204 for the purpose of holding cooperating section 202A to cooperating section 202B. Box portion 216 functions as a support means for candelabra lampholder 200 and aids in molding cooperating sections 202A and 202B.

Horizontal projections provided for support and to hold first and second strip contacts 234 and 236 extend from box portion 216. Specifically, horizontal projection 218 extends along an upper edge of box portion 216 a short distance towards sidewall 238. Similarly, horizontal projection 226 extends along an upper edge of box portion 216 a short distance towards sidewall 240. Horizontal projection 222 extends from box portion 216 from a point about two-thirds ($\frac{2}{3}$) of the distance between upper and lower edges of box portion 216 a short distance towards sidewall 238. Horizontal projection 232 extends along a lower edge of box portion 216 a short distance towards sidewall 240.

In addition, horizontal projections 220 and 224 extend from sidewall 238 a short distance towards box portion 216 and horizontal projections 228 and 230 extend from sidewall 240 a short distance towards box portion 216. Horizontal projections 220 and 228 are opposite each other and extend from sidewall 238 and 240, respectively, slightly below lower edges of horizontal projections 218 and 226. Horizontal projection 230 extends from sidewall 240 towards box portion 216 at a point just above an upper edge of horizontal projection 232. Horizontal projection 224 extends from sidewall 238 so that a lower edge of horizontal projection 224 is at approximately the same level as a lower edge of box portion 216. In use, horizontal projections 218, 220, 222 and 224 act to hold second strip contact 236 in position in candelabra lampholder 200. Similarly, horizontal projections 226, 228, 230 and 232 act to hold first strip contact 234 in position in candelabra lampholder 200.

Strip contacts 234 and 236 for use in candelabra lampholder 200 are shown in FIG. 12. First strip contact 234 has an upper vertical section 242, a horizontal section 244 adjacent upper vertical section 242, lower vertical section 246 adjacent horizontal section 244, and convex section 248 adjacent lower horizontal section 246. Cut out sections 250 and 252 in upper vertical section 242 can be folded over an uninsulated section of a first wire lead 254 in order to secure first wire lead 254 to first strip contact 234. This is similar to the arrangement described above in connection with first and second strip contacts 20 and 22 of lampholder 10. First strip contact 234 is held in position in candelabra lampholder 200 by the horizontal projections.

Second wire lead 236 has a vertical portion 252 and a horizontal portion 254. Again, cut out sections of vertical portion 252 can be folded over so as to form holes 256 and 258 and secure second wire lead 260 to second strip contact 236. Second strip contact 236 is held in position in hickey 200 by the horizontal projections and horizontal portion 254 contacts a back portion of a light bulb when the light bulb is secured in the socket 262.

Socket portion 262 has socket threads 264 having a longitudinally flattened region for fitting convex portion 248 of first strip contact 234 in position so that convex portion 248 will abut against the threaded portion of a light bulb secured in socket 262. This is similar to the socket described in connection with lampholder 10.

In addition, candelabra lampholder section 202A has raised projections 266 and 268 along an outer edge. Projections 266 and 268 correspond to recesses in candelabra lampholder section 202B. Raised projections 266 and 268 and the corresponding recesses are designed to allow cooperating sections 202A to be fitted into cooperating section 202B, and to insure alignment.

The lampholders of the present invention can be molded of any suitable material commonly used for molding lampholders and such materials are well known to those skilled in the art. Such materials include plastics of the type which are easily moldable to form hard, non-conductive bodies that are stable at temperatures in the range of those which are obtained in the presence of a lighted incandescent bulb. In a preferred embodiment, lampholder 10 is molded of high-heat phenolic or white urea.

It will thus be seen that the objects set forth above among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A light fixture lampholder having at least one bulb socket for receiving a light bulb and mounting means for mounting said lampholder to a light fixture comprising first and second complementary lampholder sections each integrally molded from a plastic material, said first and second lampholder sections each defining integrally molded portions of both said at least one bulb socket and said mounting means, at least first and second electrical contact means supported by said first and second lampholder sections for supplying an electrical current to said at least one bulb socket, and coupling means for coupling said first lampholder section to said second lamp holder section, said respective interally molded portions of said first and second lampholder sections being formed with mating surfaces at which said lampholder sections mate to form both said at least one bulb socket and said mounting means when said first and second lampholder sections are coupled by said coupling means, said integrally molded socket portions each including portions of a helical rib, said respective helical rib portions forming at least a partial spiral rib when said first and second lampholder sections are coupled to form a threaded socket for receiving a light bulb, said threaded socket including a flattened region interrupting a plurality of said helical rib portions and extending longitudinally therealong, said molded region being molded in part in each of said respective first and second lampholder sections, one side of the portion of the flattened region in each of said first and second lampholder sections abutting mating portions of each of the mating surfaces of said first and second lampholder sections, one of said first and second electrical contact means including a first conductive strip contact which extends along said flattened region.

2. The light fixture lampholder as claimed in claim 1, wherein said integrally molded mounting means portions define an internally threaded socket for threading to a screw mount on said light fixture.

3. The light fixture lampholder as claimed in claim 1, wherein said integrally molded mounting means portions form supporting ribs, further comprising spring clip means supported by said supporting ribs for coupling said lampholder to said light fixture.

4. The light fixture lampholder as claimed in claim 1, wherein at least one of said integrally molded mounting means portions includes a threaded projection which extends out of said lampholder to permit coupling of said lampholder.

5. The light fixture lampholder as claimed in claim 1, wherein the portion of said strip contact means extending along said flattened region being bowed along its length into the socket, the flattened region terminating in an end wall for limiting the flattening of said bow by a bulb as it is screwed into said socket.

6. The light fixture lampholder as claimed in claim 1, wherein said first lampholder section includes a first region which defines at least a portion of said mounting means at one end thereof, a second intermediate region which defines a portion of said at least one bulb socket and a third region defining a portion of a second mounting means at one end thereof, said second lampholder section including a fourth region which defines a cooperating portion of said mounting means, a fifth intermediate region which defines the remaining portion of said at least one bulb socket and a sixth region defining a cooperating portion of said second mounting means.

7. The light fixture lampholder as claimed in claim 6, wherein at least one of said first and fourth regions includes a first threaded projection which extends out of said lampholder, and at least one of said third and sixth regions including a second threaded projection which extends out of said lampholder, said first and second threaded projections being integrally molded with at least one of said first and second lampholder sections.

8. The light fixture lampholder as claimed in claim 6, wherein said second intermediate region further defines a portion of a second bulb socket which extends in a direction opposite to said at least one bulb socket, said fifth intermediate region further defining the remaining portion of said second bulb socket.

9. The light fixture lampholder as claimed in claim 8, wherein said first and second integrally molded lampholder sections are essentially cross-shaped in cross-section.

10. The light fixture lampholder as claimed in claim 8, wherein said second and fifth intermediate regions, when coupled, together define a first supporting section and a second supporting section, said electrical contact means including a first conductive strip contact supported by said first supporting section and a second conductive strip contact supported by said second supporting section, said first and second conductive strip contacts respectively extending to different positions in both said at least one bulb socket and said second bulb socket.

11. The light fixture lampholder as claimed in claim 10, wherein said first conductive strip contact includes a first electrical lead extending therefrom, said second conductive strip contact including a second electrical lead extending therefrom, said first and fourth regions together defining respective channels along which said first and second electrical leads extend, the ends of said first and fourth regions together defining an opening through which said first and second electrical leads can extend.

12. The light fixture lampholder as claimed in claim 11, wherein said first and fourth regions each have corresponding openings, said third and sixth regions each having corresponding openings, said coupling means including a first coupling device extending through the openings defined by said first and fourth regions, and a second coupling device extending through the openings defined by said third and sixth regions.

13. A light fixture lampholder comprising a first molded lampholder half having a first region defining at least a portion of a first mounting means for mounting said lampholder to a light fixture and a second region defining a portion of first and second opposing bulb sockets, a second molded lampholder half having a third region defining a cooperating portion of said first mounting means and a fourth region defining the remaining portion of said first and second opposing bulb sockets, said first and second molded lampholder halves being separately integrally molded from a plastic material and being formed with surfaces at which said lampholder halves mate, first and second electrical contact means supported by said first and second lampholder halves for supplying electrical current to said first and second bulb sockets, and coupling means for coupling said first lampholder half to said second lampholder half, said first region being coupled to said third region to form a complete mounting means, said second region being coupled to said fourth region to form complete first and second bulb sockets, said first and second electrical contact means being captured intermediate said first and second lampholder halves, said integrally molded second and fourth regions each including portions of a helical rib, said respective helical rib portions forming at least a partial spiral rib in each of the first and second bulb sockets when said first and second lampholder halves are coupled together for receiving light bulbs, said threaded bulb sockets each including a flattened region interrupting a plurality of said helical rib portions and extending longitudinally therealong, said flattened regions being molded in part in each of said respective first and second lampholder halves, one side of the portions of the flattened regions in each of said first and second lampholder halves abutting mating portions of each of the mating surfaces of said first and second lampholder halves, said electrical contact means including a first conductive strip contact which extends into each of said bulb sockets along the respective flattened region therein.

14. The light fixture lampholder as claimed in claim 13, wherein at least one of said first and third regions includes a molded threaded projection which extends out of said lampholder to permit coupling of said lampholder.

15. The light fixture lampholder as claimed in claim 13, wherein said first and third regions, when coupled, define a channel extending from said first and second opposing bulb sockets and an opening at one end thereof, said electrical contact means including electrical wire means which extend along said channel and out of said opening.

16. The light fixture lampholder as claimed in claim 15, wherein said first molded lampholder half includes a fifth region which extends from said second region in a direction opposite to said region which extends from said fourth region in a direction opposite to said third region, said fifth and sixth regions mating to form a supporting structure when said first and second lampholder halves are coupled.

17. The light fixture lampholder as claimed in claim 16, wherein at least one of said fifth and sixth regions include a first molded threaded stud extending off a first end thereof, said threaded stud being essentially round in cross-section except for flattened opposed sides thereof extending in planes essentially normal to the adjacent mating surface, said stud being solid except for at least one recess therein positioned about 90° circumferentially from said flattened regions.

18. The light fixture lampholder as claimed in claim 17, wherein at least one of said first and third regions includes a second molded threaded stud extending out of said lampholder to permit coupling of said lampholder.

19. The light fixture lampholder as claimed in claim 17, wherein said stud includes at least two longitudinally spaced recesses on opposed sides thereof but each positioned about 90° circumferentially from said flattened regions.

20. The light fixture lampholder as claimed in claim 1, wherein said first and second lampholder sections each include supporting sections integrally molded therewith for supporting said first and second electrical contact means.

21. The light fixture lampholder as claimed in claim 20, wherein said support sections on said first lampholder section include at least one contact supporting means shaped to receive and support at least a first of said electrical contact means during assembly of the lampholder so that the second lampholder section can be readily mated with the first lampholder section while the electrical contact means remains in position on said first lampholder section, said first electrical contact means being formed from sheet material having elongated opposed side edges and flat faces, and first electrical contact means being positioned on one side edge in the first lampholder section with the other elongated side edge facing the second lampholder section during assembly, said at least one contact supporting means on said first lampholder section including at least three supporting sections spaced longitudinally of the first electrical contact means, at least one of said at least three supporting sections being positioned on the opposite side of said first electrical contact means as two other of said at least three supporting sections, said three supporting sections bearing on the flat faces of and supporting said first electrical contact means therebetween during assembly and thereafter.

22. The light fixture lampholder as claimed in claim 21, wherein at least a portion of said supporting sections of one of said first and second lampholder sections projects toward the second lampholder section when assembled, the second lampholder section being formed with a recess for receiving the projecting portion of the supporting sections of said first lampholder section, whereby the lampholder sections are laterally positioned during assembly.

23. The light fixture lampholder as claimed in claim 13, wherein said lampholder halves including contact supporting means integrally molded therewith for supporting each of said first and second electrical contact means respectively; each of the contact supporting means on said first lampholder half being shaped to receive and support, respectively, said first and second electrical contact means during assembly of the lampholder so that the second lampholder half can be readily mated with the first lampholder half while the first and second electrical contact means remains in position on said first lampholder half, said first and second electrical contact means being each formed from sheet material having elongated opposed side edges and flat faces, said first and second electrical contact means being positioned on one side edge in the first lampholder half with the other side edge facing the second lampholder half during assembly, each said contact supporting means on said first lampholder half including at least three supporting sections spaced longitudinally of the respective electrical contact means, at least one of said at least three supporting sections being positioned on the opposite side of the associated electrical contact means as two other of said at least three supporting sections, said at least three supporting sections bearing on the flat faces of and supporting the associated electrical contact means therebetween during assembly and thereafter.

24. The light fixture lampholder as claimed in claim 23, wherein at least a portion of said supporting sections of one of said first and second lampholder means projects toward the second lampholder half when assembled, the second lampholder half being formed with a recess for receiving the projecting portion of the supporting sections of said first lampholder half, whereby the lampholder halves are laterally positioned during assembly.

25. The light fixture lampholder as claimed in claim 13, wherein said electrical contact means includes a second conductive strip contact extending into said first and second bulb sockets at a position spaced from said first conductive strip contact.

26. The light fixture lampholder as claimed in claim 25, wherein the portion of said strip contact means extending along said flattened region being bowed along its length into the socket, the flattened region terminating in an end wall for limiting the flattening of said bow by a bulb as it is screwed into said socket.

27. A light fixture lampholder having at least one bulb socket for receiving a light bulb comprising at least first and second electrical contact means for supplying an electrical current to said at least one bulb socket; and first and second complementary lampholder sections each integrally molded from a plastic material, at least one lampholder section including at least one contact supporting means integrally molded therewith for supporting at least one of said electrical contact means, said first and second lampholder sections each defining at least integrally molded portions of said at least one bulb socket, said respective integrally molded portions of said first and second lampholder sections being adapted to mate to form said at least one bulb socket when said first and second lampholder sections are coupled, said at least one contact supporting means on said first lampholder section being shaped to receive and support at least a first of said electrical contact means during assembly of the lampholder so that the second lampholder section can be readily mated with the first lampholder section while the electrical contact means remains in position on said first lampholder section, said first electrical contact means being formed from sheet material having elongated opposed side edges and flat faces, and first electrical contact means being positioned on one side edge in the first lampholder section with the other elongated side edge facing the second lampholder section during assembly, said at least one contact supporting means on said first lampholder section including at least three supporting sections spaced longitudinally of the first electrical contact means, at least one of said at least three supporting sections being positioned on the opposite side of said first electrical contact means as two other of said at least three supporting sections, said three supporting sections bearing on the flat faces of and supporting said first electrical contact means therebetween during assembly and thereafter.

28. The light fixture lampholder as claimed in claim 27, wherein at least a portion of said supporting sections of one of said first and second lampholder sections projects toward the second lampholder section when assembled, the second lampholder section being formed with a recess for receiving the projecting portion of the supporting sections of said first lampholder section, whereby the lampholder sections are laterally positioned during assembly.

29. The light fixture lampholder as claimed in claim 27, wherein said first lampholder section includes first and second of said contact supporting means for respectively supporting and retaining said first and second electrical contact means during assembly.

30. The light fixture lampholder as claimed in claim 29, and including lead wires coupled to each of said first and second electrical contact means, wherein said first lampholder section is molded with channel means for receiving said lead wires during assembly.

31. A light fixture lampholder having at least one bulb socket for receiving a light bulb and mounting means for mounting said lampholder to a light fixture comprising first and second complementary lampholder sections each integrally molded from a plastic material, said first and second lampholder sections each defining integrally molded portions of both said at least one bulb socket and said mounting means, at least first and second electrical contact means supported by said first and second lampholder sections for supplying an electrical current to said at least one bulb socket, and coupling means for coupling said first lampholder section to said second lampholder secton, said respective integrally molded portions of said first and second lampholder sections being formed with mating surfaces at which said lampholder sections mate to form both said at least one bulb socket and said mounting means when said first and second lampholder sections are coupled by said coupling means, the mounting means portion of one of the first and second lampholder sections including a first molded threaded stud extending off a first end thereof, said threaded stud being essentially round in cross-section except for flattened opposed sides thereof extending in planes essentially normal to the adjacent mating surface, said stud being solid except for at least one recess therein positioned about 90° circumferentially from said flattened regions.

32. The light fixture lampholder as claimed in claim 31, wherein said stud includes at least two longitudinally spaced recesses on opposed sides thereof but each positioned about 90° circumferentially from said flattened regions.

* * * * *